US006380475B1

(12) United States Patent
Kira

(10) Patent No.: US 6,380,475 B1
(45) Date of Patent: Apr. 30, 2002

(54) CHORD DETECTION TECHNIQUE FOR ELECTRONIC MUSICAL INSTRUMENT

(75) Inventor: Yoshifumi Kira, Hamamatsu (JP)

(73) Assignee: Kabushiki Kaisha Kawi Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/938,341

(22) Filed: Aug. 23, 2001

(30) Foreign Application Priority Data

Aug. 31, 2000 (JP) ..... 2000-263851

(51) Int. Cl.[7] ..... G10H 1/38
(52) U.S. Cl. ..... 84/637; 84/721
(58) Field of Search ..... 84/613, 637, 715, 84/721, 746

(56) References Cited

U.S. PATENT DOCUMENTS 3,844,192 A * 10/1974 Brand et al. ..... 84/715
4,065,993 A * 1/1978 Hirose ..... 84/715
4,276,801 A * 7/1981 Yerusavage ..... 84/715
4,366,739 A * 1/1983 DeLong et al. ..... 84/713
4,472,992 A * 9/1984 Okuma et al. ..... 84/637
4,864,907 A 9/1989 Oguri ..... 84/637

FOREIGN PATENT DOCUMENTS

JP 53080217 7/1978
JP 5-84920 8/1987

* cited by examiner

*Primary Examiner*—Jeffrey Donels
(74) *Attorney, Agent, or Firm*—Christie, Parker & Hale, LLP

(57) ABSTRACT

A chord detection apparatus for an electronic musical instrument has a hand keyboard for hand operation, a foot keyboard for foot operation, a hand-keyboard detection unit for detecting a temporary hand-keyboard chord root and a temporary hand-keyboard chord type in accordance with operation of the hand keyboard, a foot-keyboard detection unit for detecting a temporary foot-keyboard bass root in accordance with operation of the foot keyboard, and a determination unit for determining a true chord root and a true chord type, and the presence/absence of a bass root in accordance with the temporary hand-keyboard chord root, the temporary hand-keyboard chord type, and the temporary foot-keyboard bass root.

14 Claims, 9 Drawing Sheets

FIG. 3

| CHORD type | BASS ofset | BASS onoff | CHORD ROOT ofset | CHORD type |
|---|---|---|---|---|
| Major | 0 | OFF | 0 | Major |
| | 1 | ON | 0 | Major |
| | 2 | ON | 0 | Major |
| | 3 | ON | 0 | Major |
| | 4 | ON | 0 | Major |
| | 5 | ON | 0 | Major |
| | 6 | ON | 0 | Major |
| | 7 | ON | 0 | Major |
| | 8 | ON | 0 | Major |
| | 9 | ON | 0 | Major |
| | 10 | ON | 0 | Major |
| | 11 | ON | 0 | Major |
| aug | 0 | OFF | 0 | aug |
| | 1 | ON | 0 | aug |
| | 2 | ON | 0 | aug |
| | 3 | ON | 0 | aug |
| | 4 | OFF | 4 | aug |
| | 5 | ON | 0 | aug |
| | 6 | ON | 0 | aug |
| | 7 | ON | 0 | aug |
| | 8 | OFF | 8 | aug |
| | 9 | ON | 0 | aug |
| | 10 | ON | 0 | aug |
| | 11 | ON | 0 | aug |
| m#5 | 0 | OFF | 0 | m#5 |
| | 1 | ON | 0 | m#5 |
| | 2 | ON | 0 | m#5 |
| | 3 | ON | 0 | m#5 |
| | 4 | ON | 0 | m#5 |
| | 5 | ON | 0 | m#5 |
| | 6 | ON | 0 | m#5 |
| | 7 | ON | 0 | m#5 |
| | 8 | OFF | 8 | Δ7 |
| | 9 | ON | 0 | m#5 |
| | 10 | ON | 0 | m#5 |
| | 11 | ON | 0 | m#5 |

CHORD DETECTION TECHNIQUE FOR ELECTRONIC MUSICAL INSTRUMENT

BACKGROUND OF THE INVENTION

1. Field of the Invention

The present invention relates to chord detection techniques for electronic musical instruments, in particular, for detecting chords upon operation of hand and foot keyboards.

2. Description of the Related Art

Some electronic musical instruments have a hand keyboard for hand operation, and a foot keyboard for foot operation. The hand keyboard has dual keyboards, so that the upper keyboard is used to play a melody line, and the lower keyboard is used to play a chord line. In an electronic musical instrument having an automatic accompaniment function, chord detection is made upon operation of the lower keyboard and foot keyboard, and an automatic accompaniment according to the detected chords is made. An example of a chord detection method is described in Japanese Patent Publication No. 5-84920 (Japanese Patent Laid-Open No. 62-186298).

Chords to be detected are categorized into fraction chords (e.g., C/B), and normal chords which are not fraction chords. In a fraction chord, a numerator chord is that of an upper part (corresponding to the hand keyboard) of a music score, and a denominator chord is that of a lower part (corresponding to the foot keyboard) of the music score.

An electronic musical instrument detects chord roots of the hand and foot keyboards. When the chord root detected at the hand keyboard is different from that detected at the foot keyboard, a fraction chord (e.g., C/B) is detected. Conversely, when the chord root detected at the hand keyboard is the same as that detected at the foot keyboard, a normal chord which is a not a fraction chord is detected. However, this method cannot always precisely detect a chord, and an inappropriate chord may often be detected.

SUMMARY OF THE INVENTION

It is an object of the present invention to detect an appropriate chord in accordance with operations of hand and foot keyboards.

According to one aspect of the present invention, there is provided a chord detection apparatus for an electronic musical instrument, comprising a hand keyboard for hand operation, a foot keyboard for foot operation, a hand-keyboard detection unit for detecting a temporary hand-keyboard chord root and a temporary hand-keyboard chord type in accordance with operation of the hand keyboard, a foot-keyboard detection unit for detecting a temporary foot-keyboard bass root in accordance with operation of the foot keyboard, and a determination unit for determining a true chord root and chord type, and the presence/absence of a bass root in accordance with the temporary hand-keyboard chord root, hand-keyboard chord type, and foot-keyboard bass root.

According to another aspect of the present invention, there is provided a chord detection method for an electronic musical instrument having a hand keyboard for hand operation, and a foot keyboard for foot operation, comprising (a) the step of detecting a temporary hand-keyboard chord root and a temporary hand-keyboard chord type in accordance with operation of the hand keyboard, (b) the step of detecting a temporary foot-keyboard bass root in accordance with operation of the foot keyboard, and (c) the step of determining a true chord root and chord type, and the presence/absence of a bass root in accordance with the temporary hand-keyboard chord root, hand-keyboard chord type, and foot-keyboard bass root.

According to still another aspect of the present invention, there is provided a recording medium that records a program for an electronic musical instrument having a hand keyboard for hand operation, and a foot keyboard for foot operation, the program making a computer execute (a) a sequence for detecting a temporary hand-keyboard chord root and a temporary hand-keyboard chord type in accordance with operation of the hand keyboard, (b) a sequence for detecting a temporary foot-keyboard bass root in accordance with operation of the foot keyboard, and (c) a sequence for determining a true chord root and chord type, and the presence/absence of a bass root in accordance with the temporary hand-keyboard chord root, hand-keyboard chord type, and foot-keyboard bass root.

According to the present invention, a temporary hand-keyboard chord root and a temporary hand-keyboard chord type are detected in accordance with operation of the hand keyboard, and a temporary foot-keyboard bass root is detected in accordance with operation of the foot keyboard. Since these chords are used as temporary ones, and a true chord root and chord type, and the presence/absence of a bass root are determined later in accordance with the temporary hand-keyboard chord root, hand-keyboard chord type, and foot-keyboard bass root, an appropriate chord can be detected.

BRIEF DESCRIPTION OF THE DRAWINGS

FIG. 3 shows the contents of a table;

DETAILED DESCRIPTION OF THE PREFERRED EMBODIMENTS

Figure 1:
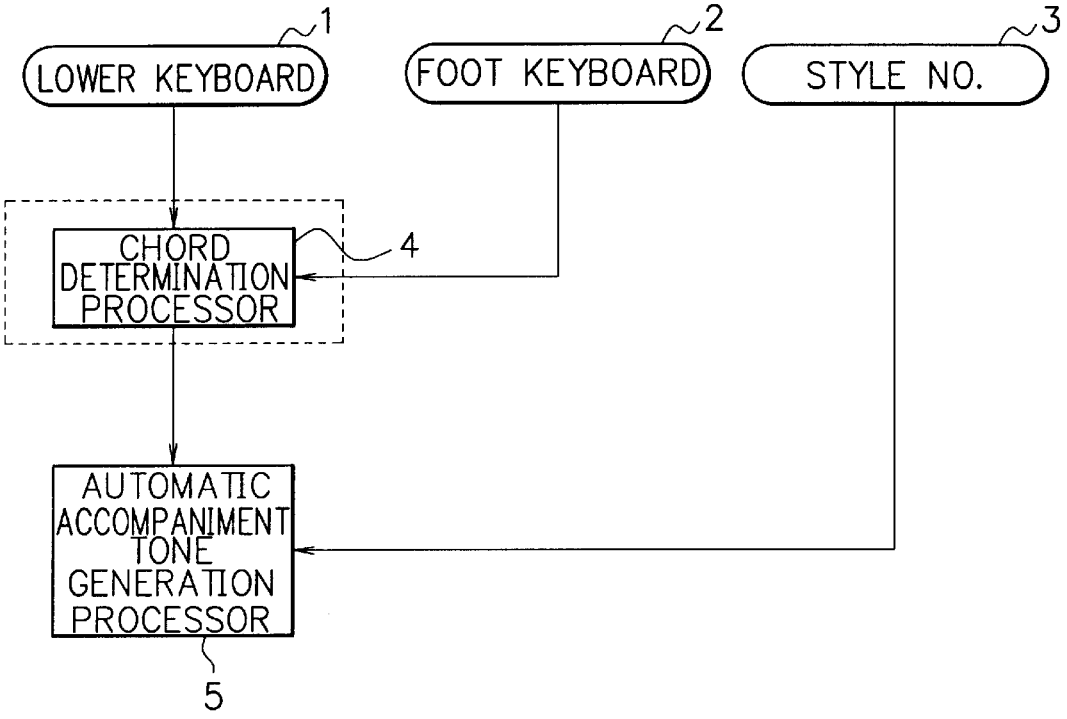
FIG. 1 is a diagram showing an example of construction of an electronic musical instrument according to an embodiment of the present invention.

FIG. 1 shows an example of construction of an electronic musical instrument according to an embodiment of the present invention. The electronic musical instrument has a hand keyboard for hand operation, and a foot keyboard 2 for foot operation. The hand keyboard has dual keyboards, and has an upper keyboard used to play a melody line, and a lower keyboard 1 used to play a chord line.

When the player has depressed a key on the lower keyboard 1, the lower keyboard 1 outputs a key-ON event; when the player has released the key on the lower keyboard 1, the lower keyboard 1 outputs a key-OFF event. A chord determination processor 4 detects a temporary lower-keyboard chord root and a temporary lower-keyboard chord type in accordance with the key-ON/OFF event of the lower keyboard 1.

When the player has depressed a key on the foot keyboard 2, the foot keyboard 2 outputs a key-ON event; when the player has released the key on the foot keyboard 2, the foot keyboard 2 outputs a key-OFF event. The chord determination processor 4 detects a temporary foot-keyboard bass root in accordance with the key-ON/OFF event of the foot keyboard 2.

The chord determination processor 4 determines a true chord root and a true chord type, and the presence/absence of a bass root in accordance with the temporary lower-keyboard chord root, the lower-keyboard chord type, and the foot-keyboard bass root. If a bass root is present, the temporary foot-keyboard bass root is determined as a true bass root, thus detecting a fraction chord. The denominator of the fraction code specifies a bass root, and its numerator specifies a true chord root. If the absence of a bass root is determined, a normal chord which is not a fraction chord is detected.

A style number switch 3 is used to select an automatic accompaniment style such as rock, jazz, or the like, and outputs a style number in accordance with switch operation.

An automatic accompaniment tone generation processor 5 reads out an automatic accompaniment pattern corresponding to the style number, and generates automatic accompaniment tones in accordance with the true chord root, the true chord type, and the bass root. An automatic accompaniment is achieved by repetitively producing tones of, e.g., predetermined drum, chord (piano tones, guitar tones, or the like), and bass patterns. Chord tones are produced in accordance with the true chord root and chord type, and bass tones are produced in accordance with the bass root.

Figure 2:
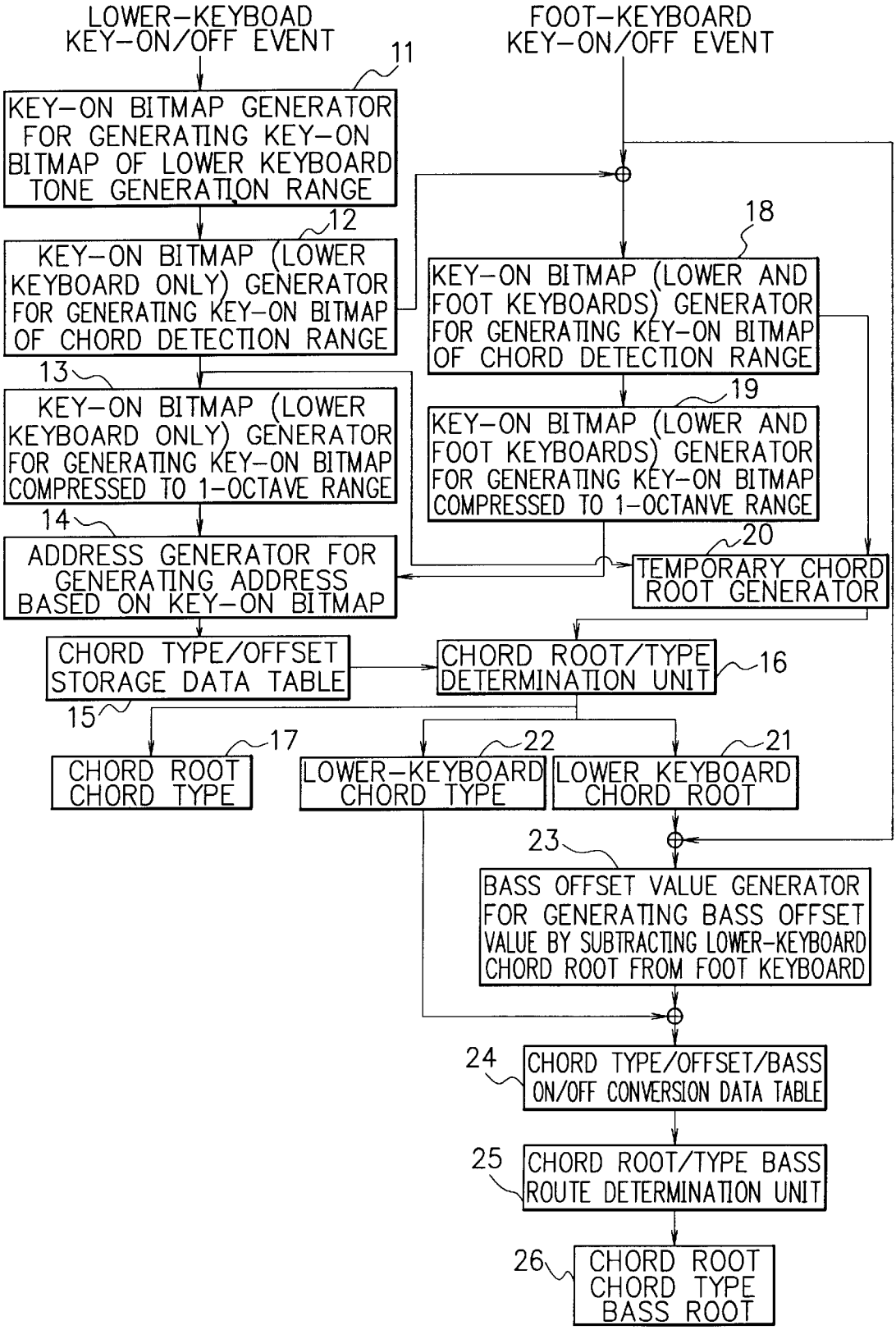
FIG. 2 is a block diagram showing the construction of a chord determination processor.

FIG. 2 shows a specific construction of the chord determination processor 4 of FIG. 1. When the player has simultaneously depressed three or more keys on the lower keyboard, a chord root and a chord type can be detected based on their key-ON events. However, when the player has depressed only one or two keys on the lower keyboard, it is difficult to detect a chord root and a chord type based on their key-ON events. Hence, a chord is detected in accordance with operations of the lower and foot keyboards in such a case.

A case will be explained first wherein the player has simultaneously depressed three or more keys on the lower keyboard. Upon receiving key-ON/OFF events of the lower keyboard, a first key-ON bitmap generator 11 generates all key numbers (pitches) of ON-keys that have been depressed on the lower keyboard, as a first key-ON bitmap. In this case, "1" is set in bits of key numbers of ON-keys, and "0" is set in bits of key numbers of OFF-keys.

A second key-ON bitmap generator 12 detects only key numbers falling within a chord detection range from the first key-ON bitmap, and generates a second key-ON bitmap.

A temporary chord root generator 20 detects the lowest pitch in the second key-ON bit map as a temporary chord root. On the other hand, a third key-ON bitmap generator 13 generates a third key-ON bitmap compressed to fall within a one-octave range on the basis of the second key-ON bitmap. That is, the generator 13 expresses as a pitch name within one octave that starts from the lowest pitch serving as the temporary chord root. In this case, since the lowest pitch serving as the temporary chord root must have bit =1, the third key-ON bitmap can be generated by 11 bits by omitting the bit of the lowest pitch.

An address generator 14 generates an address required to look up a table on the basis of the third key-ON bitmap. A table 15 outputs a lower-keyboard chord type and offset in accordance with the address. A determination unit 16 receives the temporary chord root from the temporary chord root generator 20, and the lower-keyboard chord type and offset from the table 15. The determination unit 16 adds the offset to the temporary chord root to correct it, and outputs the corrected lower-keyboard chord root and lower-keyboard chord type to memories 21 and 22.

The chord root memory 21 stores the corrected lower-keyboard chord root. The chord type memory 22 stores the lower-keyboard chord type. A bass offset value generator 23 receives a key-ON/OFF event of the foot keyboard, and generates a bass offset value by subtracting the lower-keyboard chord root in the chord root memory 21 from a key number (bass root) in the key-ON event of the foot keyboard. This bass offset value corresponds to a bass offset value (BASS ofset) in the second term in the table shown in FIG. 3.

A table 24 receives the lower-keyboard chord type (first term in FIG. 3) in the chord type memory 22, and the bass offset value (second term in FIG. 3) generated by the bass offset value generator 23, and outputs ON/OFF of a bass root (third term in FIG. 3), a chord root offset value (fourth term in FIG. 3), and a chord type (fifth term in FIG. 3).

A determination unit 25 determines a true chord root and a true chord type, and determines ON/OFF (presence/absence) of a bass root. The true chord root is obtained by adding the chord root offset value in the fourth term in FIG. 3 to the lower-keyboard chord root in the chord root memory 21. The true chord type is a chord type in the fifth term in FIG. 3. ON/OFF of the bass root is that in the third term in FIG. 3. If the bass root is ON (present), the key number (bass root) of the foot keyboard is determined to be a true bass root.

A memory 26 stores the true chord root, a true chord type, and ON/OFF of the bass root, and also the bass root if the bass root is ON.

For example, when the chord type is "Major" and the bass offset value is "0" in FIG. 3, and, for example, when a chord "C" is detected on the lower keyboard, and a key "C" is depressed on the foot keyboard, the true chord root is "C" and the true chord type is "Major". Also, the bass root is OFF.

When the chord type is "Major" and the bass offset value is "11", and, for example, when a chord "C" is detected on the lower keyboard, and a key "B" is depressed on the foot keyboard, the true chord root is "C", the true chord type is "Major", and the bass root is "B".

On the other hand, when the chord type is "aug" and the bass offset value is "4", and, for example, when a chord "Caug" is detected on the lower keyboard, and a key "E" is depressed on the foot keyboard, the true chord root is "E", the true chord type is "aug", and the bass root is OFF. In this case, in a simple process, "Caug/E" is detected. However, since this chord is inappropriate, the chord root is corrected. Furthermore, even when the lower-keyboard chord root is different from the foot-keyboard bass root, the bass root is OFF.

Likewise, when the chord type is "aug" and the bass offset value is "8", and, for example, when a chord "Caug" is detected on the lower keyboard, and a key "A♭" is depressed on the foot keyboard, the true chord root is "A♭", the true chord type is "aug", and the bass root is OFF. In this case as well, the chord root is corrected, and the bass root is OFF.

When the chord type is "aug" and the bass offset value is "11", and, for example, when a chord "Caug" is detected on the lower keyboard, and a key "B" is depressed on the foot keyboard, the true chord root is "C", the true chord type is "aug", and the bass root is "B".

When the chord type is "m#5" and the bass offset value is "8", and, for example, when a chord "Cm#5" is detected on the lower keyboard, and a key "A♭" is depressed on the foot keyboard, the true chord root is "A♭", the true chord type is "Δ7", and the bass root is OFF. In this case, the chord root and chord type are corrected, and the bass root is OFF.

When the chord type is "m#5" and the bass offset value is "11", and, for example, when a chord "Cm#5" is detected on the lower keyboard, and a key "B" is depressed on the foot keyboard, the true chord root is "C", the true chord type is "m#5", and the bass root is "B".

In this way, the table 24 determines the presence/absence of a bass root irrespective of whether or not the temporary hand-keyboard chord root is the same as the temporary foot-keyboard bass root, and may determine the absence of a bass root in some cases even when the temporary hand-keyboard chord root and temporary foot-keyboard bass root are different. The table 24 may often output a true chord root and chord type which are different from the temporary chord root and chord type in accordance with the temporary chord type and bass offset value.

A method of detecting a chord in accordance with operations of the lower and foot keyboards upon depressing only one or two keys on the lower keyboard in FIG. 2 will be explained below. A fourth key-ON bitmap generator 18 detects only key numbers falling within the chord detection ranges of the lower and foot keyboards on the basis of the second key-ON bitmap generated by the second key-ON bitmap generator 12 and the key-ON/OFF event of the foot keyboard, and generates a fourth key-ON bitmap.

A temporary chord root generator 20 detects one key (e.g., a lowest pitch) of the foot keyboard as a temporary chord root. On the other hand, a fifth key-ON bitmap generator 19 generates a fifth key-ON bitmap compressed to fall within a one-octave range on the basis of the fourth key-ON bitmap. In this case, since the lowest pitch serving as the temporary chord root must have a bit="1", the fifth key-ON bitmap can be generated by 11 bits by omitting the bit of the lowest pitch.

The address generator 14 generates an address required to look up the table on the basis of the fifth key-ON bitmap. The table 15 outputs a lower-keyboard chord type and offset in accordance with the address. The determination unit 16 receives the temporary chord root from the temporary chord root generator 20, and the lower-keyboard chord type and offset from the table 15. The determination unit 16 adds the offset to the temporary chord root to correct it, and stores the corrected lower-keyboard chord root and lower-keyboard chord type in a memory 17. In this case, the bass root is OFF.

Figure 4:
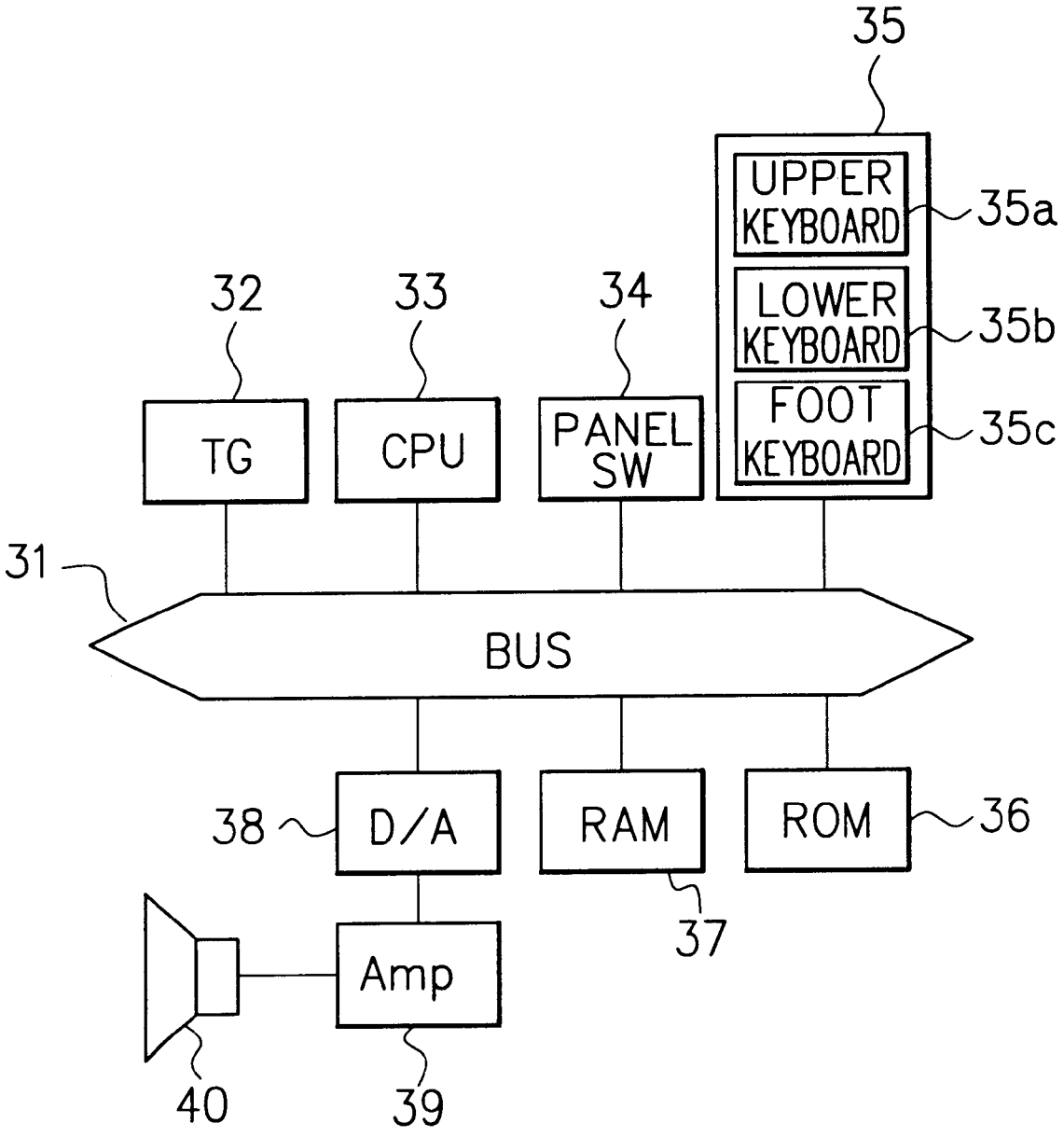
FIG. 4 is a block diagram showing the hardware construction of the electronic musical instrument.

FIG. 4 is a block diagram showing the hardware construction of the electronic musical instrument of this embodiment. A tone generator (TG) 32, a CPU 33, panel switches 34, a keyboard 35, a ROM 36, a RAM 37, and a D/A converter 38 are connected to a bus 31.

The CPU 33 makes various arithmetic operations or processes, and executes processes shown in the flowcharts of FIGS. 5 to 9 and the like (to be described later) in accordance with a computer program stored in the ROM 36. The RAM 37 is used as a work area of the CPU 33. The panel switches 34 include operation members such as the style number switch 3 (FIG. 1) for determining an automatic accompaniment style number, and the like.

The keyboard 35 has a hand keyboard including upper and lower keyboards 35*a* and 35*b*, and a foot keyboard 35*c*, and has a number of keys that can be depressed and released. Upon depressing a key on the keyboard 35, the keyboard 35 supplies a key-ON event containing a velocity (key-ON velocity) and key code (pitch) to the CPU 33; upon releasing the key, the keyboard 35 supplies a key-OFF event to the CPU 33.

The tone generator 32 generates a tone signal in accordance with operations on the keyboard 35 or automatic accompaniment data in the ROM 36. The D/A converter 38 converts a digital tone signal generated by the tone generator 32 into an analog signal, and outputs it to an amplifier 39. The amplifier 39 amplifies the tone signal, and actual tones are produced through a loudspeaker 40.

Figure 5:
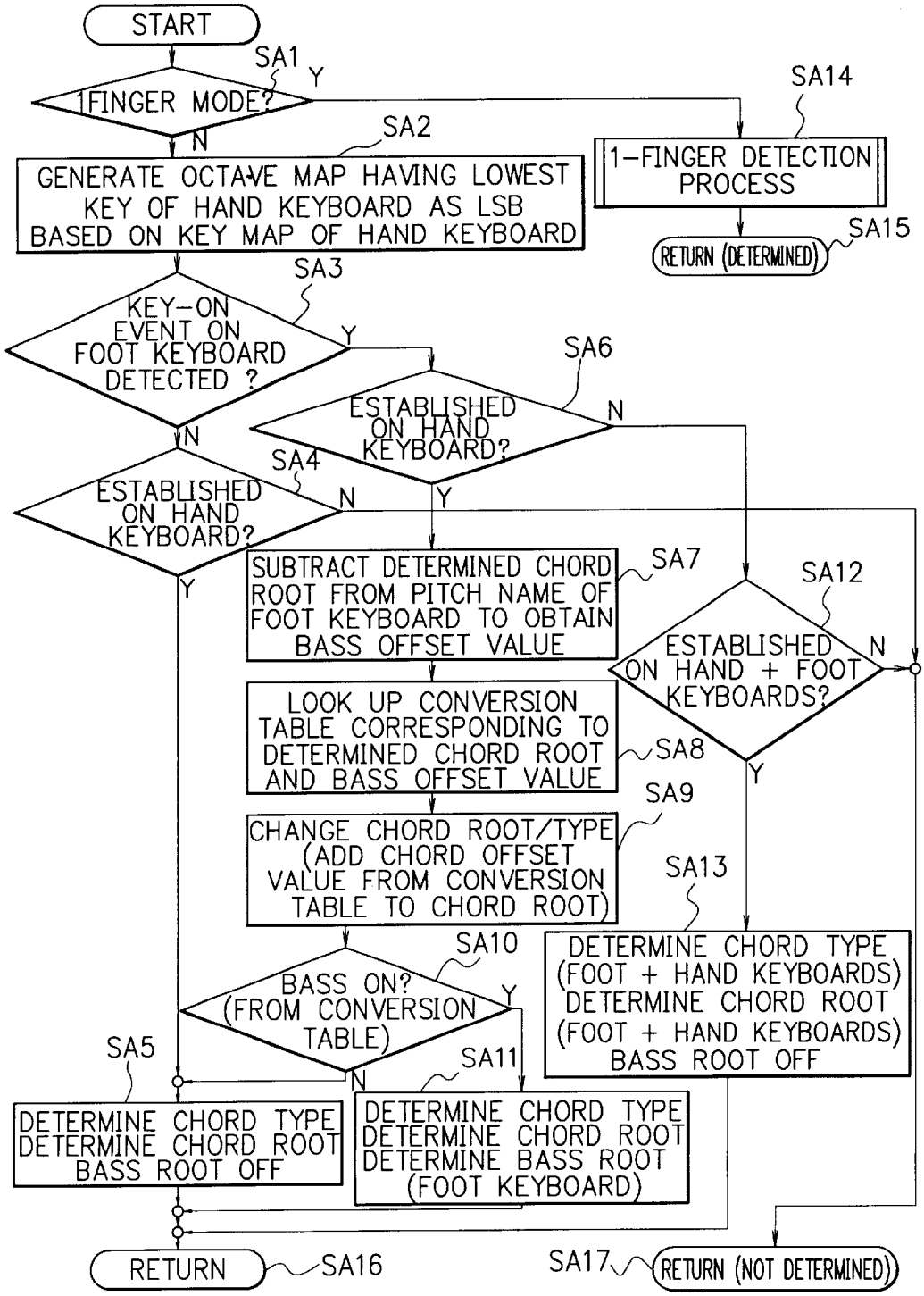
FIG. 5 is a flowchart showing a chord detection process.

FIG. 5 is a flowchart showing a chord detection process executed by the CPU 33 in FIG. 4. It is checked in step SA1 if a one-finger switch of the panel switches 34 (FIG. 4) is ON. If YES in step SA1, a one-finger detection process is executed in step SA14, and a chord root and a chord type are determined in step SA15. Details of the process in step SA14 will be described later with reference to the flowchart of FIG. 6.

If the one-finger switch is OFF, the flow advances to step SA2. In step SA2, a bitmap for one octave is generated to have the key of the lowest pitch of the lower keyboard as the LSB on the basis of a key-ON bitmap of the lower keyboard.

It is checked in step SA3 if an ON key is detected on the foot keyboard. If YES in step SA3, the flow advances to step SA6; otherwise, the flow advances to step SA4.

It is checked in step SA6 if a chord is established by ON-keys on the lower keyboard. If YES in step SA6, the flow advances to step SA7; otherwise, the flow advances to step SA12.

In step SA7, the chord root determined on the lower keyboard is subtracted from the pitch name of the foot keyboard to obtain a bass offset value. The table is looked up in accordance with the chord root of the lower keyboard and the bass offset value in step SA8, and the chord root and the chord type are changed in step SA9. The chord root is changed by adding a chord offset value read out from the conversion table to the aforementioned chord root.

It is checked based on the conversion table in step SA10 if a bass root is ON. If YES in step SA10, the flow advances to step SA11; otherwise, the flow advances to step SA5.

In step SA11, a chord type, a chord root (lower keyboard), and a bass root (foot keyboard) are determined. After this, the flow advances to step SA16 to end the process.

In step SA5, a chord type and a chord root are determined, and a bass root=OFF is set. After this, the flow advances to step SA16 to end the process.

It is checked in step SA12 if a chord is established by keys operated on the lower and foot keyboards. If YES in step SA12, the flow advances to step SA13; otherwise, the flow advances to step SA17 not to determine a chord, and the previous chord remains unchanged.

In step SA13, a chord type and a chord root are determined in accordance with the operations of the lower and foot keyboards, and a bass root=OFF is set. After this, the flow advances to step SA16 to end the process.

It is checked in step SA4 if a chord is established by only keys depressed on the foot keyboard. If YES in step SA4, a chord type and a chord root are determined, and a bass root=OFF is set. After this, the flow advances to step SA16 to end the process. On the other hand, if NO in step SA4, the flow advances to step SA17 not to determine a chord, and the previous chord remains unchanged.

Figure 6:
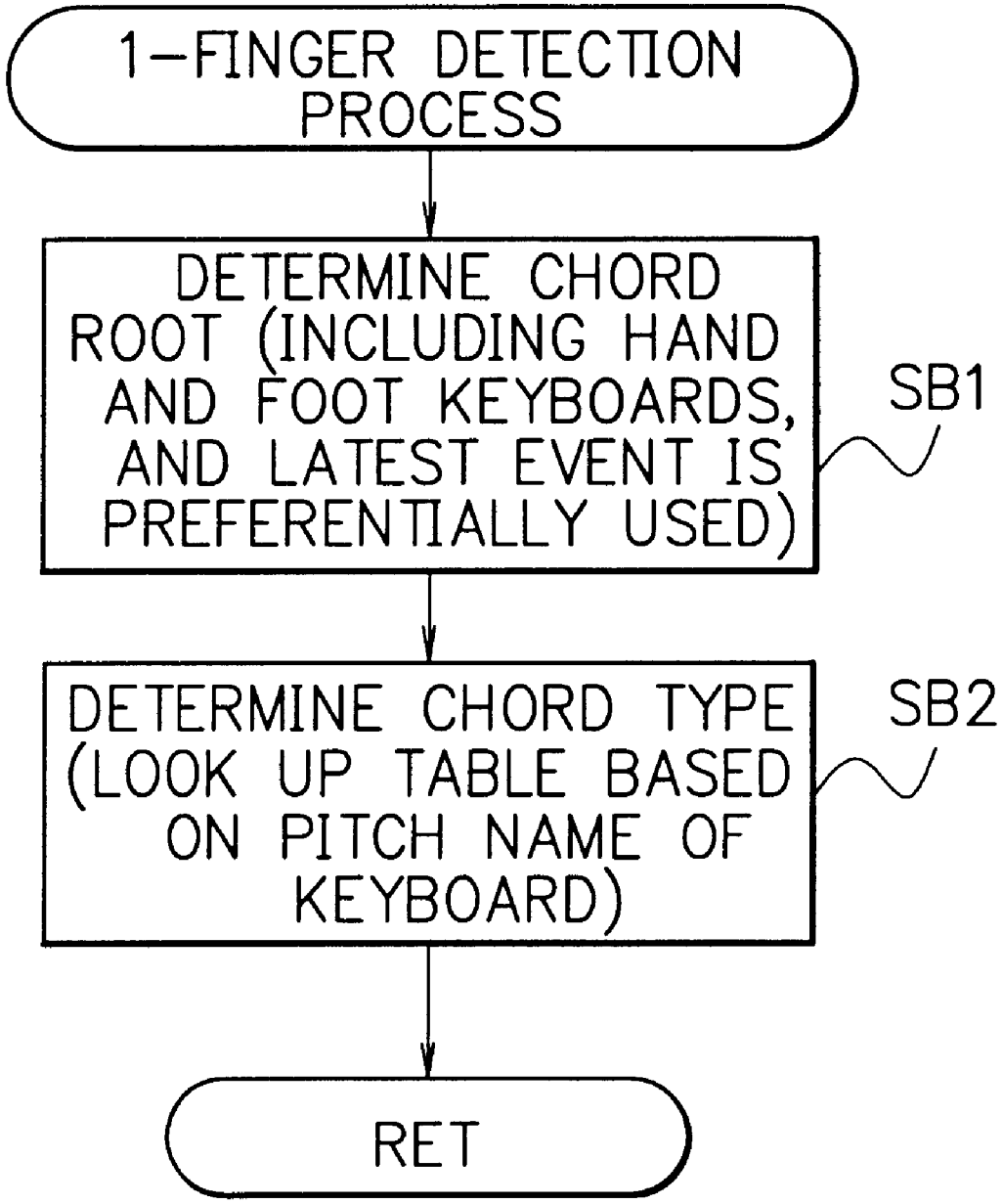
FIG. 6 is a flowchart showing a one-finger detection process.

FIG. 6 is a flowchart showing details of the one-finger detection process in step SA14 in FIG. 5. In step SB1, one key depressed on the lower or foot keyboard is determined as a chord root. If two or more keys have been depressed, the key which was depressed last is determined as a chord root. In step SB2, the table is looked up in accordance with the chord root to determine a chord type. For example, the table stores chord development of a tune in C major: if the chord root is "C", the chord is "C"; if the chord root is "D", the chord is "Dm"; if the chord root is "E", the chord is "Em"; if the chord root is "F", the chord is "F", and so forth. In this way, a chord root and a chord type are determined.

Figure 7:
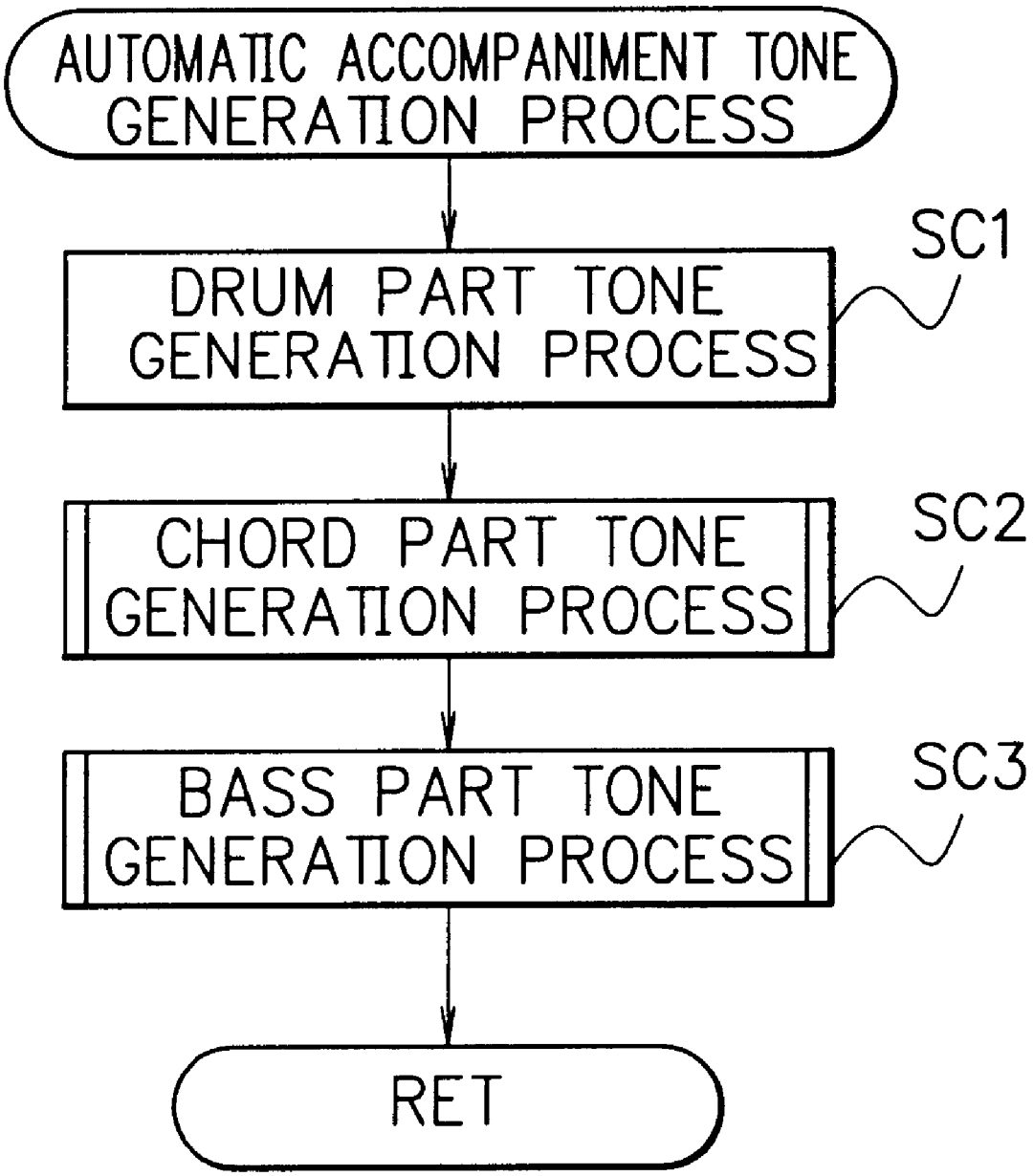
FIG. 7 is a flowchart showing an automatic accompaniment tone generation process.

FIG. 7 is a flowchart showing the automatic accompaniment tone generation process executed by the CPU 33 in FIG. 4. In step SC1, a tone generation process of a drum part is executed irrespective of the detected chord. In step SC2, a tone generation process of a chord part is executed in accordance with the detected chord. Details of this process will be described later with reference to the flowchart in FIG. 8. In step SC3, a tone generation process of a bass part is executed in accordance with the detected chord. Details of this process will be described later with reference to the flowchart in FIG. 9.

Figure 8:
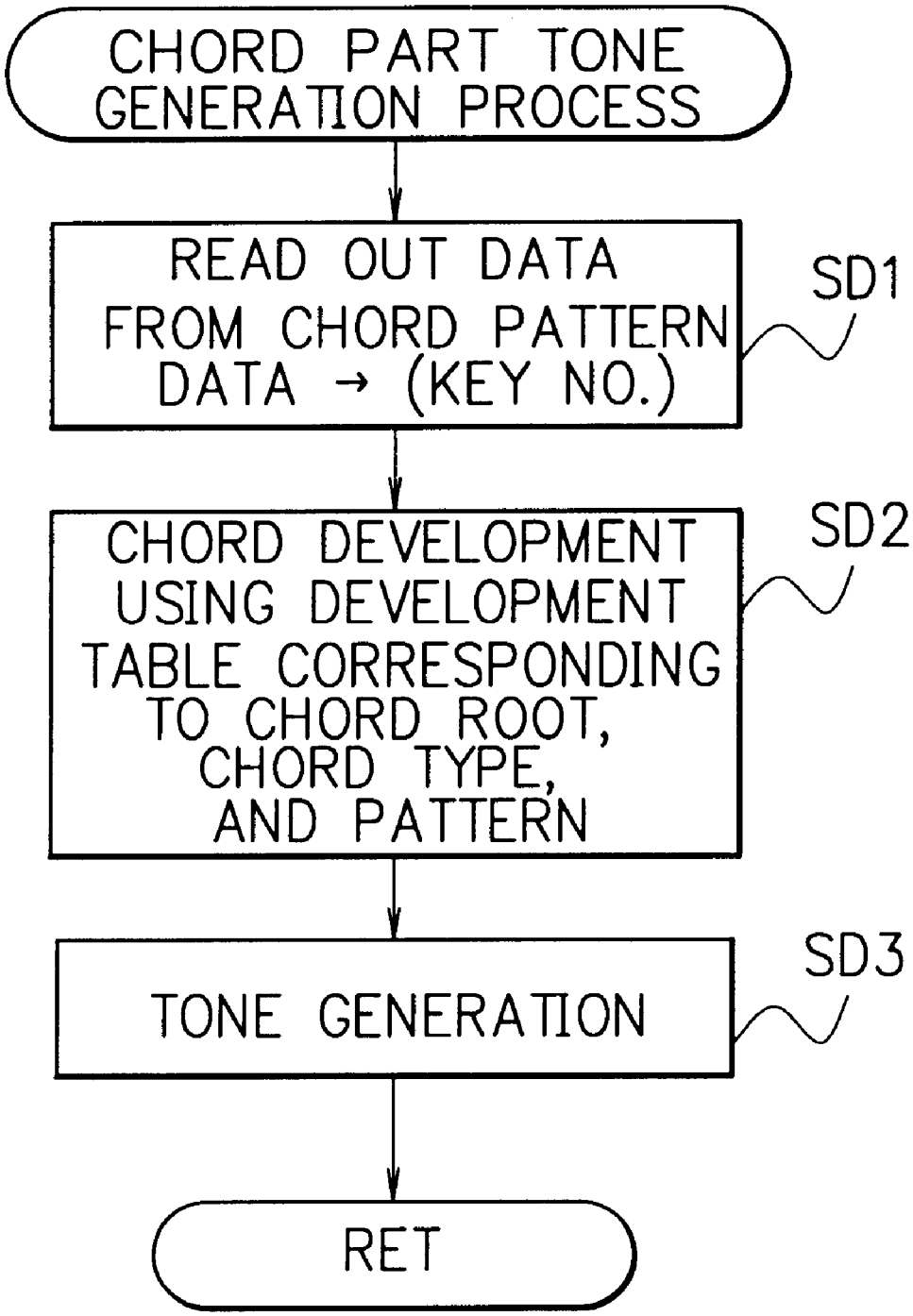
FIG. 8 is a flowchart showing a chord part tone generation process.

FIG. 8 is a flowchart showing details of the chord part tone generation process in step SC2 in FIG. 7. In step SD1, data such as a key number or the like is read out from chord pattern data in the ROM 36 (FIG. 4). In step SD2, chord development is made using the development table corresponding to the pattern data in accordance with the detected chord root and chord type. In step SD3, a tone generation process is executed.

Figure 9:
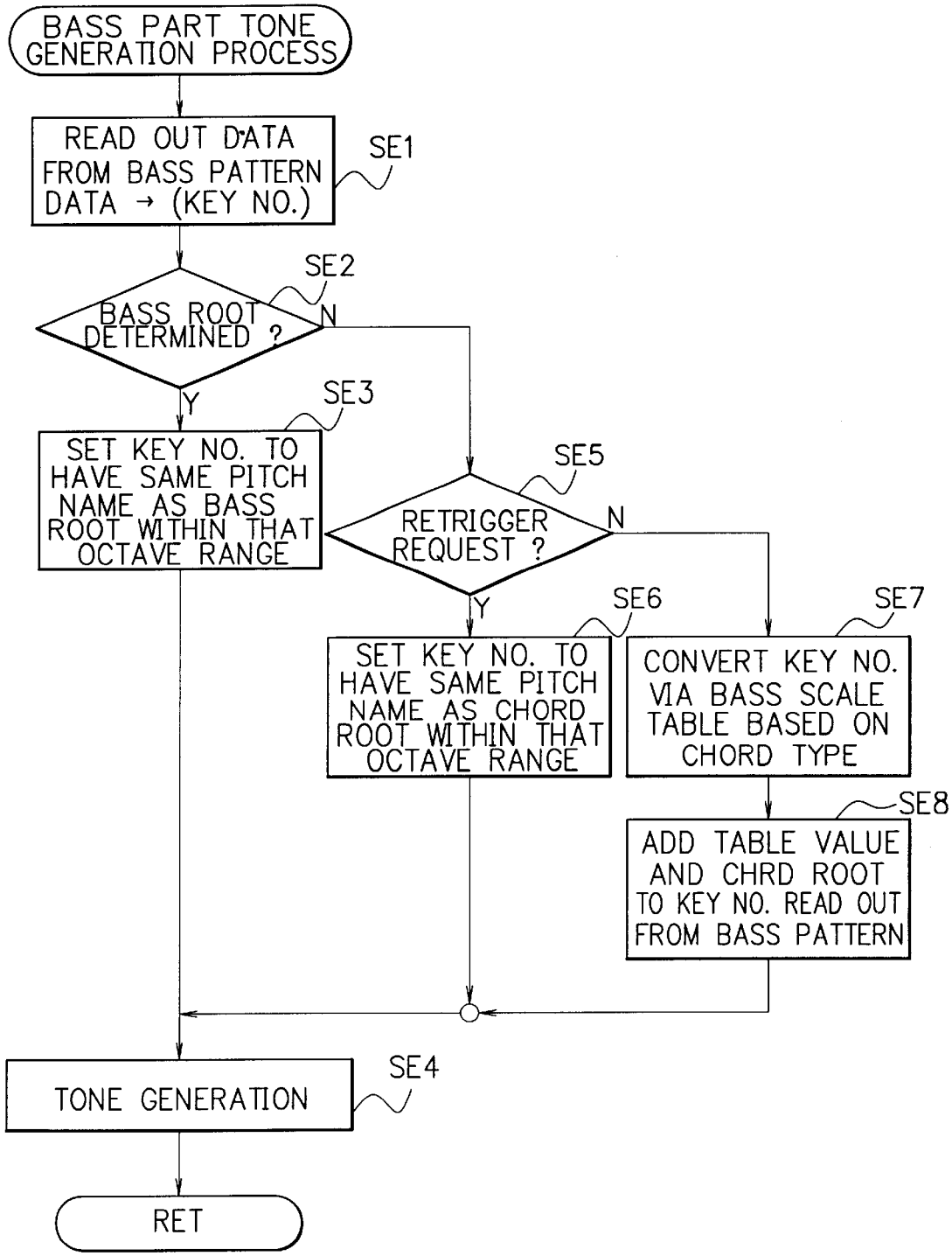
FIG. 9 is a flowchart showing a bass part tone generation process.

FIG. 9 is a flowchart showing details of the bass part tone generation process in step SC3 in FIG. 7. In step SE1, data such as a key number or the like is read out from bass pattern data in the ROM 36 (FIG. 4). It is checked in step SE2 if a bass root is determined by the above chord detection.

If YES in step SE2, the read-out key number is set to be the same pitch name as a bass root within its octave (identical octave) range in step SE3. That is, the pitch name is always a bass root, and only the octave changes. In step SE4, a tone generation process is executed.

If a bass root is not determined, the flow advances to step SE5. It is checked in step SE5 if a g retrigger request (chord change request) is issued.

If YES in step SE5, the flow advances to step SE6. The read-out key number is set to be the same pitch name as a chord root within its octave range in step SE6. That is, upon changing a chord, a change in chord is clarified by producing a tone of the chord root. After this, a tone generation process is executed in step SE4.

If a retrigger request is not issued, the flow advances to step SE7. In step SE7, the read-out key number is converted using a bass scale table in accordance with a chord type to obtain a table value. In step SE8, the table value and chord root are added to the key number read out from the bass pattern. In this case, a chord root "C" is expressed by "0"; "D" by "2", and so on. After this, a tone generation process is executed in step SE4.

According to this embodiment, a temporary hand-keyboard chord root and hand-keyboard chord type are detected in accordance with operations on the hand keyboard (lower keyboard), and a temporary foot-keyboard bass root is detected in accordance with operation on the foot keyboard. Since these chords are used as temporary ones, and a true chord root and chord type, and the presence/absence of a bass root are determined later in accordance with the temporary hand-keyboard chord root, hand-keyboard chord type, and foot-keyboard bass root, an appropriate chord can be detected.

The presence/absence of a bass root is determined independently of whether or not the temporary hand-keyboard chord root and the temporary foot-keyboard bass root are the same, and the absence of a bass root may be often determined even when the temporary hand-keyboard chord root and the temporary foot-keyboard bass root are different.

A true chord root different from the temporary hand-keyboard chord root, and a true chord type different from the temporary hand-keyboard chord type may be often determined depending on the temporary hand-keyboard chord root, hand-keyboard chord type, and foot-keyboard bass root.

The scope of the present invention includes a case wherein a software program code that implements the functions of the embodiment is supplied to a computer (CPU or MPU) of an electronic musical instrument to make it operate in accordance with the stored program.

In this case, the software program code itself implements the functions of the above embodiment, and the program code itself, and means for supplying the program code to the computer (e.g., a recording medium that stores the program code) constitutes the present invention. As the recording medium that stores the program code, for example, a floppy disk, a hard disk, an optical disk, a magneto-optical disk, a CD-ROM, a magnetic tape, a nonvolatile memory card, a ROM, or the like may be used.

The above embodiment merely exemplifies an example of an embodiment upon practicing the present invention, and does not limit the technical scope of the present invention. That is, various modifications of the present invention may be made without departing from its technical scope or its principal feature.

As described above, a temporary hand-keyboard chord root and hand-keyboard chord type are detected in accordance with operations on the hand keyboard, and a temporary foot-keyboard bass root is detected in accordance with operation on the foot keyboard. Since these chords are used as temporary ones, and a true chord root and chord type, and the presence/absence of a bass root are determined later in accordance with the temporary hand-keyboard chord root, hand-keyboard chord type, and foot-keyboard bass root, an appropriate chord can be detected.

What is claimed is:

1. A chord detection apparatus for an electronic musical instrument, said apparatus comprising:

a hand keyboard for hand operation;

a foot keyboard for foot operation;

a hand-keyboard detection unit for detecting a temporary hand-keyboard chord root and a temporary hand-keyboard chord type in accordance with operation of said hand keyboard;

a foot-keyboard detection unit for detecting a temporary foot-keyboard bass root in accordance with operation of said foot keyboard; and a determination unit for determining a true chord root and a true chord type, and the presence/absence of a bass root in accordance with said temporary hand-keyboard chord root, said temporary hand-keyboard chord type, and said temporary foot-keyboard bass root.

2. The apparatus according to claim 1, wherein said determination unit determines the presence/absence of a bass root independently of whether or not said temporary hand-keyboard chord root is the same as said temporary foot-keyboard bass root, and may determine the absence of a bass root even when said temporary hand-keyboard chord root and said temporary foot-keyboard bass root are different from each other.

3. The apparatus according to claim 2, wherein said determination unit determines the presence/absence of a bass root in accordance with a difference between said temporary hand-keyboard chord root and said temporary foot-keyboard bass root.

4. The apparatus according to claim 3, wherein said determination unit determines said temporary foot-keyboard bass root as a true bass root when said determination unit is to determine the presence of a bass root.

5. The apparatus according to claim 4, wherein said determination unit determines the presence/absence of a bass root in accordance with a table.

6. The apparatus according to claim 1, wherein said determination unit determines a true chord root different from said temporary hand-keyboard chord root in accordance with said temporary hand-keyboard chord root, said temporary hand-keyboard chord type, and said temporary foot-keyboard bass root.

7. The apparatus according to claim 6, wherein said determination unit determines a true chord root in accordance with a difference between said temporary hand-keyboard chord root and said temporary foot-keyboard bass root.

8. The apparatus according to claim 7, wherein said determination unit determines a true chord root in accordance with a table.

9. The apparatus according to claim 1, wherein said determination unit determines a true chord type different from said temporary hand-keyboard chord type in accordance with said temporary hand-keyboard chord root, said temporary hand-keyboard chord type, and said temporary foot-keyboard bass root.

10. The apparatus according to claim 9, wherein said determination unit determines a true chord type in accordance with a difference between said temporary hand-keyboard chord root and said temporary foot-keyboard bass root.

11. The apparatus according to claim 10, wherein said determination unit determines a true chord type in accordance with a table.

12. A chord detection method for an electronic musical instrument having a hand keyboard for hand operation, and a foot keyboard for foot operation, said method comprising the steps of:

(a) detecting a temporary hand-keyboard chord root and a temporary hand-keyboard chord type in accordance with operation of said hand keyboard;

(b) detecting a temporary foot-keyboard bass root in accordance with operation of said foot keyboard; and (c) determining a true chord root and a true chord type, and the presence/absence of a bass root in accordance with said temporary hand-keyboard chord root, said temporary hand-keyboard chord type, and said temporary foot-keyboard bass root.

13. A recording medium recording thereon a program for an electronic musical instrument having a hand keyboard for hand operation, and a foot keyboard for foot operation, said program being for making a computer execute the procedures of:

(a) detecting a temporary hand-keyboard chord root and a temporary hand-keyboard chord type in accordance with operation of said hand keyboard;

(b) detecting a temporary foot-keyboard bass root in accordance with operation of said foot keyboard; and (c) determining a true-chord root and a true chord type, and the presence/absence of a bass root in accordance with said temporary hand-keyboard chord root, said temporary hand-keyboard chord type, and said temporary foot-keyboard bass root.

14. A program for an electronic musical instrument having a hand keyboard for hand operation, and a foot keyboard for foot operation, said program being for making a computer execute the procedures of:

(a) detecting a temporary hand-keyboard chord root and a temporary hand-keyboard chord type in accordance with operation of said:hand keyboard;

(b) detecting a temporary foot-keyboard bass root in accordance with operation of said foot keyboard; and (c) determining a true chord root and a rue chord type, and the presence/absence of a bass root in accordance with said temporary hand-keyboard chord root, said temporary hand-keyboard chord type, and said temporary foot-keyboard bass root.

* * * * *